US005161581A

United States Patent [19]

Scheetz

[11] Patent Number: 5,161,581

[45] Date of Patent: Nov. 10, 1992

[54] PROTECTIVE PLUMBING SLEEVE

[76] Inventor: Kenneth S. Scheetz, R.D. #2, Box 61, Kintnersville, Pa. 18930

[21] Appl. No.: 705,948

[22] Filed: May 28, 1991

[51] Int. Cl.[5] ..... B65D 59/06; F16C 55/00

[52] U.S. Cl. ..... 138/96 R; 138/89

[58] Field of Search ..... 51/181 NT, 241 S, 205 R, 51/205 WG; 52/34, 35, 303; 29/426.4, 426.1; 138/89, 96 R, 92, 110; 220/266; 228/154, 214, 205

[56] References Cited

U.S. PATENT DOCUMENTS

| | | | |
|---|---|---|---|
| 1,982,567 | 11/1934 | Blanchard | 220/266 |
| 2,118,073 | 5/1938 | Pittmeyer | 138/96 R |
| 2,145,705 | 1/1939 | Wodtke | 138/89 |
| 2,585,602 | 2/1952 | Turner | 138/89 |
| 3,168,799 | 2/1965 | Johnson | 51/205 R |
| 3,319,328 | 5/1967 | Finger | 138/89 |
| 3,358,898 | 12/1967 | Medkeff | 138/79 |
| 3,583,460 | 6/1971 | Faust | 138/96 R |
| 4,844,322 | 7/1989 | Flowers | 228/205 |

FOREIGN PATENT DOCUMENTS

| | | | |
|---|---|---|---|
| 186013 | 7/1986 | European Pat. Off. | 228/205 |
| 540681 | 3/1956 | Italy | 220/266 |

*Primary Examiner*—Philip R. Coe
*Assistant Examiner*—Terrence R. Till
*Attorney, Agent, or Firm*—Leon Gilden

[57] ABSTRACT

A plumbing sleeve is mounted about an extending and projecting portion of rigid conduit pipe within a construction site to provide protection to the conduit pipe prior to a soldering procedure. A modification of the invention includes an elongate sleeve member directed through an associated wall structure of a construction site with perforations permitting removal of the protective end portion. A modification of the invention further includes an abrasive web and flux paste cylindrical portion mounted within a protective sleeve adjacent an opening thereof.

1 Claim, 3 Drawing Sheets

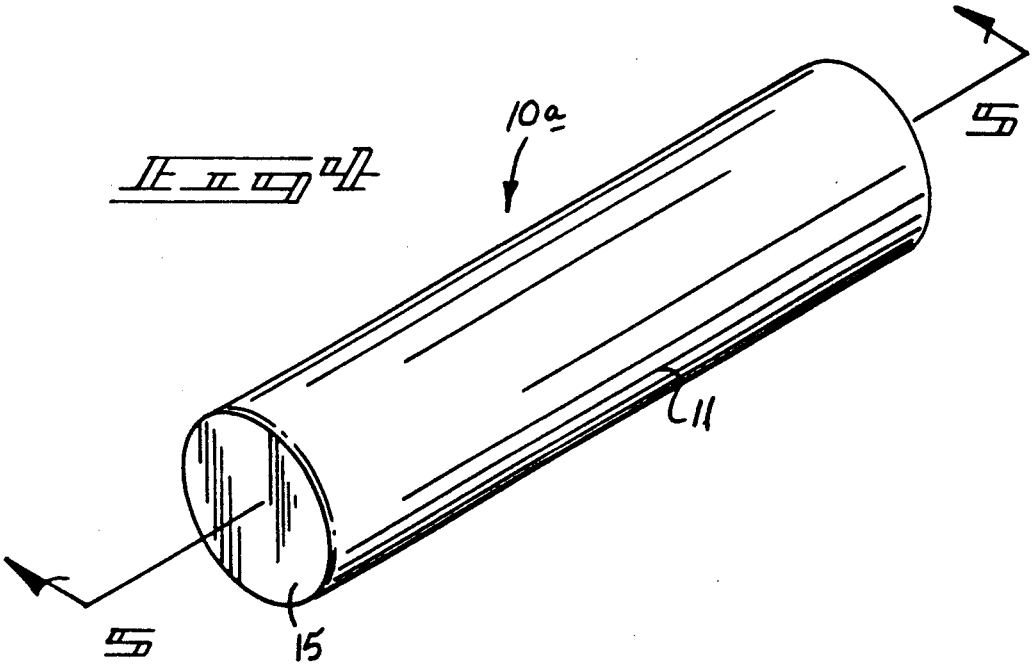
FIG 4
FIG 5
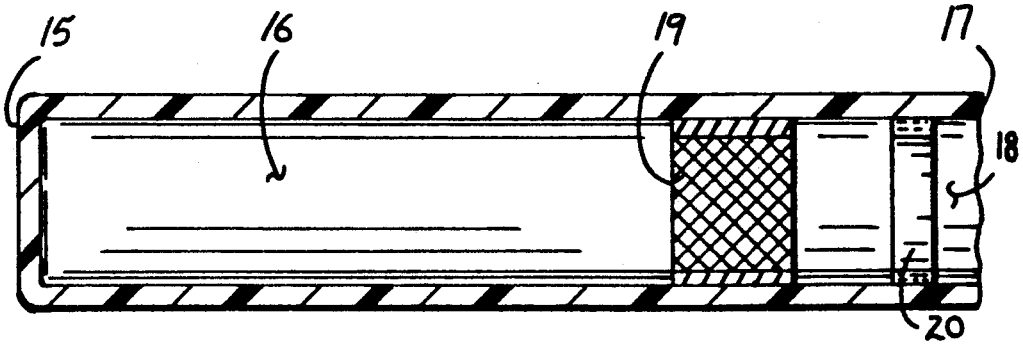

PROTECTIVE PLUMBING SLEEVE

BACKGROUND OF THE INVENTION

1. Field of the Invention

The field of invention relates to plumbing apparatus, and more particularly pertains to a new and improved protective plumbing sleeve wherein the same is arranged for affording protection to plumbing conduit prior to its subsequent soldering and securement to remaining plumbing structure.

2. Description of the Prior Art

Construction sites are formed with a supporting concrete slab and the like positioned within a ground work base, with plumbing directed through the slab and associated framework for subsequent connection. Extended periods of exposure of the plumbing deteriorates such plumbing and associated damage thereto. The invention sets forth a protection covering for mounting about a forward terminal end of plumbing prior to its connection to further plumbing structure.

Prior art protective structure are exemplified in U.S. Pat. No. 3,266,188 to Budd wherein a protective canopy member is positioned about shrub work.

U.S. Pat. No. 2,444,722 to Bogoslowsky sets forth an enclosure for tubular containers, wherein such tubular containers are arranged for filling with various products.

As such, it may be appreciated that there continues to be a need for a new and improved protective plumbing sleeve as set forth by the instant invention which addresses both the problems of ease of use as well as effectiveness in construction in providing protective sleeve structure for use in plumbing environments and in this respect, the present invention substantially fulfills this need.

SUMMARY OF THE INVENTION

In view of the foregoing disadvantages inherent in the known types of plumbing apparatus now present in the prior art, the present invention provides a protective plumbing sleeve wherein the same is arranged for mounting about exposed terminal ends of plumbing fixtures. As such, the general purpose of the present invention, which will be described subsequently in greater detail, is to provide a new and improved protective plumbing sleeve which has all the advantages of the prior art plumbing apparatus and none of the disadvantages.

To attain this, the present invention provides a plumbing sleeve mounted about an extending and projecting portion of rigid conduit pipe within a construction site to provide protection to the conduit pipe prior to a soldering procedure. A modification of the invention includes an elongate sleeve member directed through an associated wall structure of a construction site with perforations permitting removal of the protective end portion. A modification of the invention further includes an abrasive web and flux paste cylindrical portion mounted within a protective sleeve adjacent an opening thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective plumbing sleeve which has all the advantages of the prior art plumbing apparatus and none of the disadvantages.

It is another object of the present invention to provide a new and improved protective plumbing sleeve which may be easily and efficiently manufactured and marketed.

It is a further object of the present invention to provide a new and improved protective plumbing sleeve which is of a durable and reliable construction.

An even further object of the present invention is to provide a new and improved protective plumbing sleeve which is susceptible of a low cost of manufacture with regard to both materials and labor, and which accordingly is then susceptible of low prices of sale to the consuming public, thereby making such protective plumbing sleeves economically available to the buying public.

Still yet another object of the present invention is to provide a new and improved protective plumbing sleeve which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of a modification of the invention.

FIG. 5 is an orthographic view, taken along the lines 5—5 of FIG. 4 in the direction indicated by the arrows.

DESCRIPTION OF THE PREFERRED EMBODIMENT

Figure 1:
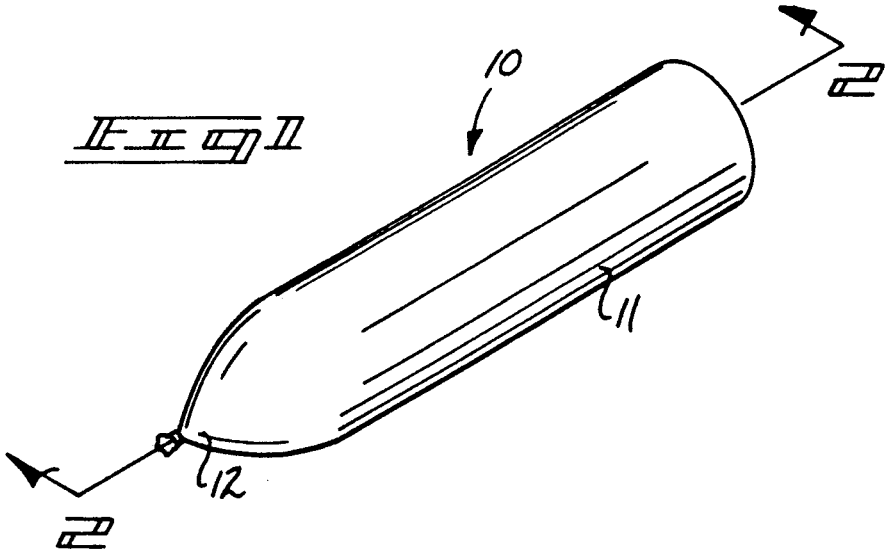
FIG. 1 is an isometric illustration of a sleeve structure utilized by the instant invention.
Figure 2:
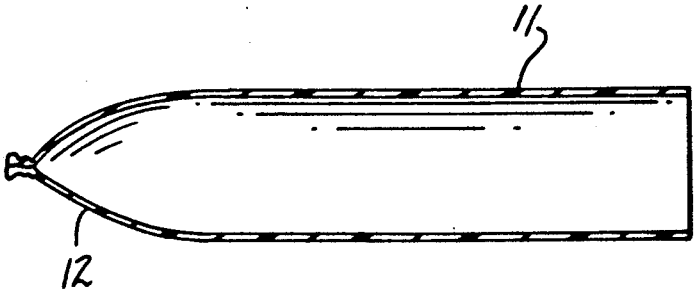
FIG. 2 is an orthographic view, taken along the lines 2—2 of FIG. 1 in the direction indicated by the arrows.
Figure 3:
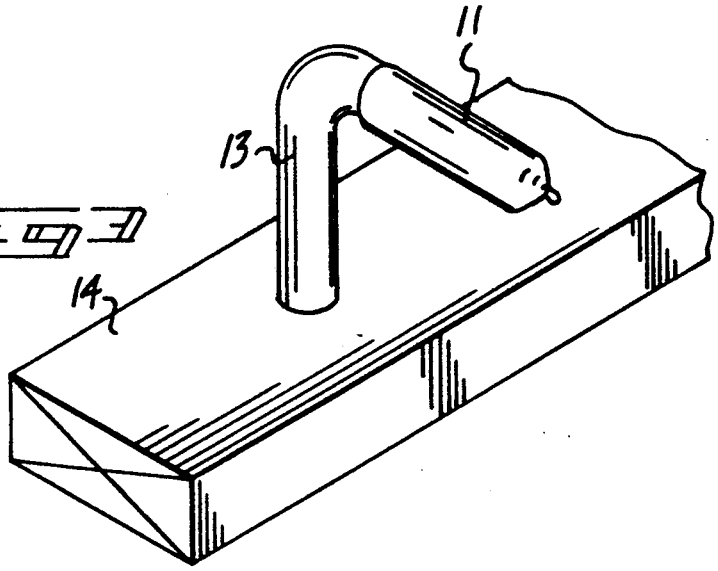
FIG. 3 is an isometric illustration of the instant invention in use.

With reference now to the drawings, and in particular to FIGS. 1 to 6 thereof, a new and improved protective plumbing sleeve embodying the principles and concepts of the present invention and generally designated by the reference numerals 10, 10*a*, and 10*b* will be described.

More specifically, the protective plumbing sleeve 10 of the invention essentially comprises a flexible tube 11 formed with a tube end wall 12 arranged for mounting about a free terminal end of an associated plumbing conduit member 13 that projects from a construction sill plate 14. The members are of a flexible construction permitting protective and surrounding engagement relative to the conduit 13 protecting such conduit from inadvertent injury, debris, and the like from inhibiting proper connection, such as with soldering to subsequent piping required for development of a plumbing system within a dwelling or other construction. Typically, copper piping is utilized, although PVC piping requires similar protection.

FIG. 4 illustrates a modified sleeve member 10*a*, including a planar enclosure web 15 orthogonally oriented relative to an axis defined by the tube 11. The tube 11 defines a cylindrical sleeve cavity 16 to complementarily receive plumbing tubing therewithin and a forward sleeve opening 18 to receive such tubing. A cylindrical abrasive web 19 of torroidal configuration is mounted within the cavity 16 and fixedly secured to an interior surface of the tube 11, with a soldering flux paste cylindrical portion 20 also of torroidal configuration spaced from and parallel the abrasive web 19. The abrasive web 19 is spaced from the closure web 15 a first spacing, with a second spacing defined between the abrasive web 19 and the paste cylindrical portion 20. The soldering flux paste is of a type typically utilized in soldering procedures involving copper tubing, as is conventionally and contemporarily utilized in construction. A third spacing is defined between the paste cylindrical portion 20 and the forward sleeve end 17. The first spacing is greater than the second spacing, with the second spacing greater than the third spacing. The positioning of the abrasive web 19 and the cylindrical portions 20 adjacent the forward end 17 is required to permit an individual to properly clean and solder the free end of the associated conduit 13 in use for preparing the conduit for subsequent soldering.

Figure 6:
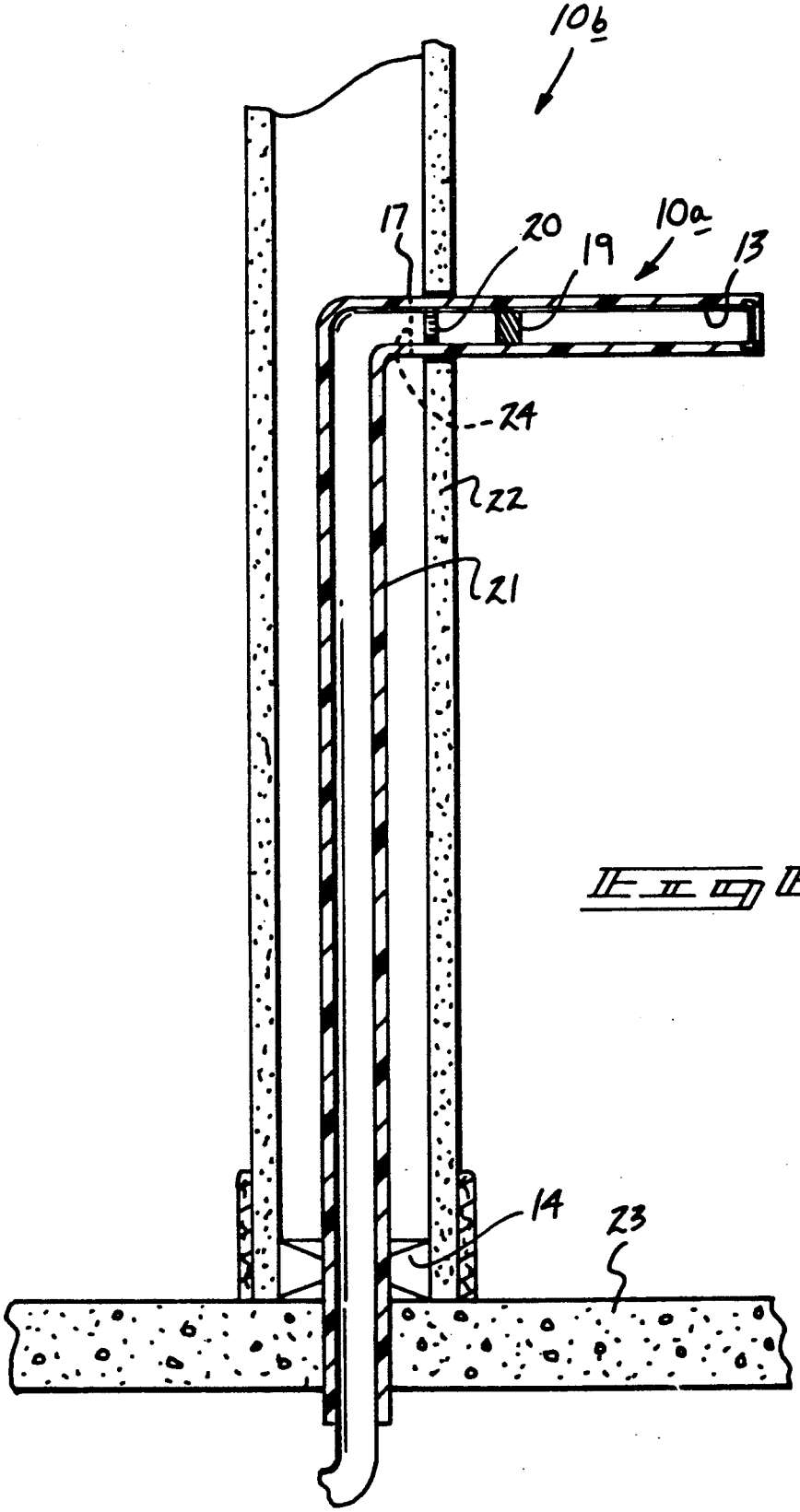
FIG. 6 is an orthographic cross-sectional illustration of a further modification of the invention in use in a construction site.

FIG. 6 illustrates a further modified sleeve construction 10*b*, wherein a sleeve extension 21 is secured to the tube 11 by means of a perforated circle 24 to permit ease of removal of the tube 11 relative to the sleeve extension 21. The sleeve extension 21 is positioned within the walls 22 overlying the concrete slab 23 and the projection of the conduit 13 through the sill plate 14. This accommodates various building code requirements in providing protection to the plumbing conduit in relationship to surrounding members. In this manner, the extension 21 remains with the conduit 13 and the tube 11 is removed permitting subsequent preparation of the conduit 13 for subsequent soldering.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected Letters Patent of the U.S. is as follows:

1. A protective plumbing sleeve comprising, a flexible tube member, the tube member including a flexible end web at a rear end of the flexible tube, and a forward sleeve end spaced from the flexible end web, and the flexible tube includes a sleeve cavity, the sleeve cavity defined by the flexible tube interior surface, and a soldering flux paste cylindrical torroidal portion positioned within the interior surface adjacent the forward sleeve end, and a cylindrical torroidal abrasive web mounted to the interior surface spaced from the paste cylindrical portion between the paste cylindrical portion and the end web, and the abrasive web spaced from the end web a first spacing, the abrasive web spaced from the cylindrical portion a second spacing, and the past cylindrical portion spaced from the forward sleeve end a third spacing, wherein the first spacing is greater than the second spacing, wherein the first spacing is greater than the second spacing and the second spacing is greater than the third spacing to position the abrasive web and the past cylindrical portion relative to a plumbing conduit for preparation of the plumbing conduit, and a flexible sleeve extension, the flexible sleeve extension removably secured to the forward sleeve end, the flexible sleeve extension defined by a further tube member, and the further tube member and the flexible tube defined by an equal diameter, and the sleeve extension mounted to the forward sleeve end by a perforated circle removably mounting the sleeve extension to the flexible tube.

* * * * *